US006012553A

United States Patent [19]

Liebetrau et al.

[11] Patent Number: 6,012,553

[45] Date of Patent: Jan. 11, 2000

[54] MOUNT FOR A LIFT CAGE SAFETY DEVICE

[75] Inventors: Christoph Liebetrau, Menziken, Switzerland; Ortwin Piper, Schwieberdingen; Albrecht Morlok, Horb, both of Germany

[73] Assignee: Inventio AG, Hergiswil NW, Switzerland

[21] Appl. No.: 09/053,461

[22] Filed: Apr. 1, 1998

[30] Foreign Application Priority Data

Apr. 11, 1997 [EP] European Pat. Off. ..... 97810218

[51] Int. Cl.[7] ..... B66B 5/04

[52] U.S. Cl. ..... 187/367; 187/368

[58] Field of Search ..... 187/367, 368, 187/370, 374, 375; 188/188, 189

[56] References Cited

U.S. PATENT DOCUMENTS 5,159,995 11/1992 Sissala et al. ..... 187/88

FOREIGN PATENT DOCUMENTS 543337 5/1993 European Pat. Off. .
562931 9/1993 European Pat. Off. .
650479 7/1985 Switzerland .
138601 2/1921 United Kingdom ..... 187/368

*Primary Examiner*—Kenneth W. Noland
*Attorney, Agent, or Firm*—Schweitzer Cornman Gross & Bondell LLP

[57] ABSTRACT

A mount for the safety device in a lift cage comprises an assembly for maintaining a catch system in a readiness position and for the movement thereof in at least one plane during the braking process. A catch housing is supported horizontally fixed in the readiness position and is held in the readiness position by a resilient plate lightly braced against the catch housing. When the safety device is triggered into a braking process the catch housing is urged upwardly against the resilient plate, out of the readiness position wherein the horizontal fixing is cancelled and self-centering of the catch housing in relation to the guide rails can occur. The transmission of braking/catching forces to the cage is damped and progressively sprung through the compression of the resilient plate.

8 Claims, 2 Drawing Sheets

MOUNT FOR A LIFT CAGE SAFETY DEVICE

The present invention relates to a mount for a safety device for a lift cage, whereby the safety device is fixed in a readiness position, and can be moved out of the readiness position in at least one plane of motion during the braking process resulting from activation of the safety device.

BACKGROUND OF THE INVENTION

An elevator or lift cage safety device must, in the ready position, be held in a defined position in which, with a minimum spacing relative to a guide surface of a guide rail against which the safety device bears in the activated state, no contact of either an active or a passive part of the safety device takes place. The minimum spacing relative to the guide rail is required in order to achieve a short reaction time for the safety device when triggered. For this purpose, in known embodiments a lateral abutment is provided against which the safety device is urged by means of a spring force, the safety device thus adopting a defined position of readiness. In one such embodiment the safety device can be laterally displaced against the spring force to adopt a self-centering position without exerting lateral pressure on the guide shoe.

A safety device of the aforesaid kind is disclosed in Swiss Patent No. 650 479. The safety device is mounted to be laterally displaceable and is pressed by means of a compression spring against an adjustable abutment. The play between the cage guide rail and the passive part of the safety device can be set by means of a setting or adjustment screw. The passive part of a safety device is the side of the device disposed opposite a catch roller or a catch wedge, wherein the catch roller or the catch wedge is correspondingly identified as the action part.

In the disclosed arrangement large vertical forces, which require correspondingly large frictional forces to halt the lateral displacement, arise during triggering of the safety device. A retarded horizontal displacement leads to a delayed brake engagement and to an amplified braking jolt and increases the injury risk to passengers in the lift cage.

The tripping of the safety device and its engagement with the cage guide rail or other fixed element generates an abrupt increase in the vertical retardation or braking force, which must be accepted and withstood by the cage construction. It is accordingly desirable that this steep increase in the vertical retardation forces be transmitted in a weakened or damped manner to the cage construction. European Patent Application EP 0 562 931 depicts a construction in which such results are partly accommodated. A safety device, which is rigidly mounted at its side, can move vertically upwardly against spring forces through a defined travel distance when the safety device engages. Compression springs arranged above the safety device providing such spring forces allow the vertical retardation force on the cage construction to rise linearly during braking and can thus, with optimum dimensioning, correspondingly reduce the retardation jolt. However, such optimum dimensioning of the springs cannot be made to accommodate differing degrees of cage loading, and accordingly appropriate compromises have to be made.

It is an object of the present invention to provide an improved mount for a safety device having simple construction, which is self-centering, has required horizontal displaceability and which displays gentle force transmission to the cage construction.

The invention is distinguished inter alia in that a catch housing of the safety device in the readiness position is urged vertically against a mechanically positive positioning device, whereby a defined position in the horizontal plane is achieved. The catch housing, when braking is triggered, is displaced from the readiness position, and automatically aligns with the guide rail, and allows the application of retardation forces on the cage construction. The catch housing is freely movable after the triggering.

A quasi mechanically positive positioning of the safety device in the readiness position may be achieved by means of conically pointed pins on one side and preferably conically pointed bores on the other side between the catch housing and the safety device holder.

A resilient plate may be positioned between an upper side of the catch housing and a lower side of a carrier plate. Bias exerted by the resilient plate presses and maintains the catch housing in the readiness position with the quasi mechanically positive support. During activation and braking the mechanically positive support is cancelled to allow for self-centering while simultaneously effecting a damped and sprung transmission of the retardation forces to the cage construction.

A rubber plate with matched Shore hardness is preferably provided as resilient plate. The resilient plate may be provided on its side facing the catch housing with a slide foil for eased lateral displacement during the self-centering.

Balls and spherical recesses as well as knife-edge and notch can be provided as horizontal fixing elements.

The mount, according to the invention, of the safety device is usable with both roller and wedge safety devices. The mount can be arranged below or above a lift cage.

BRIEF DESCRIPTION OF THE DRAWINGS

The present invention is more fully explained in the following description by reference to an illustrative embodiment as described and illustrated in the annexed drawings, wherein.

DETAILED DESCRIPTION OF THE INVENTION

Figure 1:
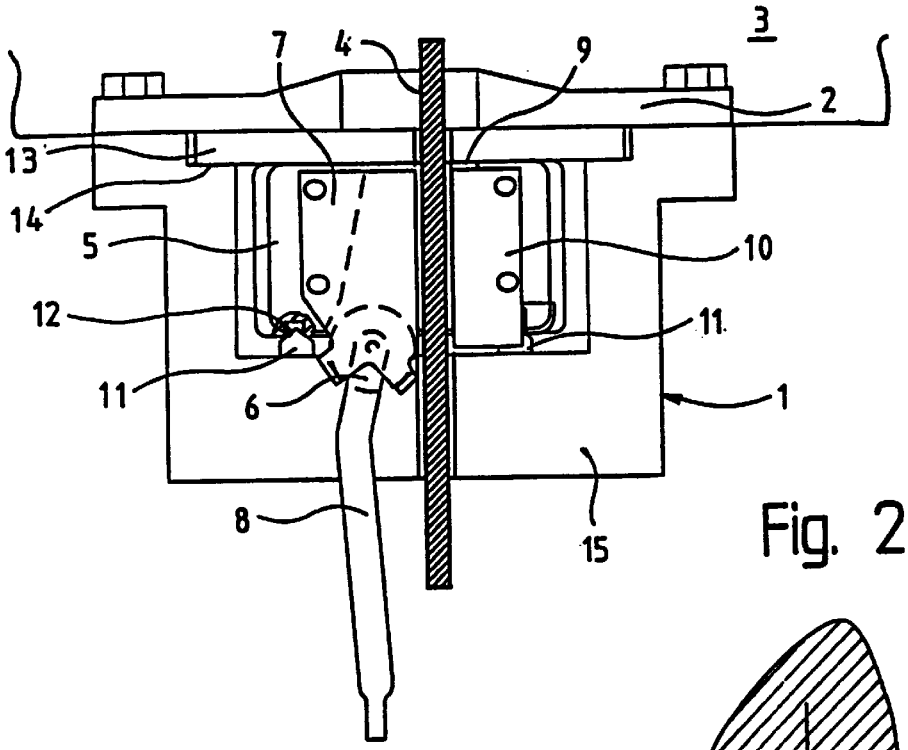
FIG. 1 shows a safety device in accordance with the present invention in a readiness position.

FIG. 1 shows a safety device 1 which is firmly connected with a part 3 of a lift cage construction and is arranged around a guide rail 4, in a readiness position. The safety device 1 and the mount portion thereof comprises a generally U-shaped safety device holder 15 with lateral projections at its two upper limb ends, and a carrier plate 2 coupled to the lift cage construction part 3, which is placed on the safety device holder 15 and is screw-connected therewith at the projecting limb ends. The actual safety device includes a catch housing 5 arranged within the safety device holder 15. As shown, the lefthand side of the catch housing 5 has an inclined track and a roller 6, which can be pushed upwardly into the catch position from a readiness position where it is guided to the inclined track by a pressing or trigger rod 8. The catch roller 6 is disposed in the readiness position at a lower abutment or support therefor formed by the lower, bent over ends (best seen in FIG. 2) of retaining metal plate 7 mounted to the catch housing 5. Inserted into the righthand half of the catch housing is a release wedge 9, which is not more fully described here, the upper end of which is visible behind a retaining metal plate 10.

The catch housing 5 is supported on pointed cones 11, which are mounted to the horizontal inner base of the catch device holder 15. Conically tapered bores 12, which are arranged in geometric agreement with the pointed cones 11, are located upon the underside of the catch housing 5 as receiving members for the support cones. A thick resilient plate 13, which in its central portion has an aperture to accommodate the guide rail 4 and which is covered at its underside by a slide foil 14, is disposed below the carrier plate 2 and is supported upon offsets or internal shoulders at the top of safety device holder 15. The height of the interior space of the safety device holder 15 is so dimensioned that the catch housing 5 bears fully against the underside of the resilient plate 13 and the slide foil 14 with some bias resulting from an initial degree of compression of the resilient plate. This biassing force urges the catch housing downward, onto the quasi mechanically positive support for the catch holder between the pointed cones 11 and conically pointed bores 12. So urged, such support provides a defined position for the safety device and in particular for the catch housing 5 in the readiness position, wherein a sufficient air gap is maintained between the guide rail 4 and the catch roller 6 as well as between the release wedge 9 and the guide rail 4.

Figure 2:
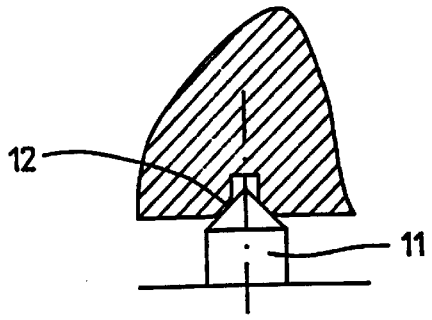
FIG. 2 shows a detail of mechanically positive support in the readiness position.

FIG. 2 shows an enlarged detail of the mounting of the catch housing utilizing a pointed cone 11 and a corresponding bore 12 in accordance with the invention. The conically pointed bore 12 has a cylindrical center bore portion, so that a secure flank contact with the cone is achieved. The position of the pointed cone 11 and the fastening thereof, for example by welding, is defined during assembly by engagement of the cones with the catch housing's bores.

Figure 3:
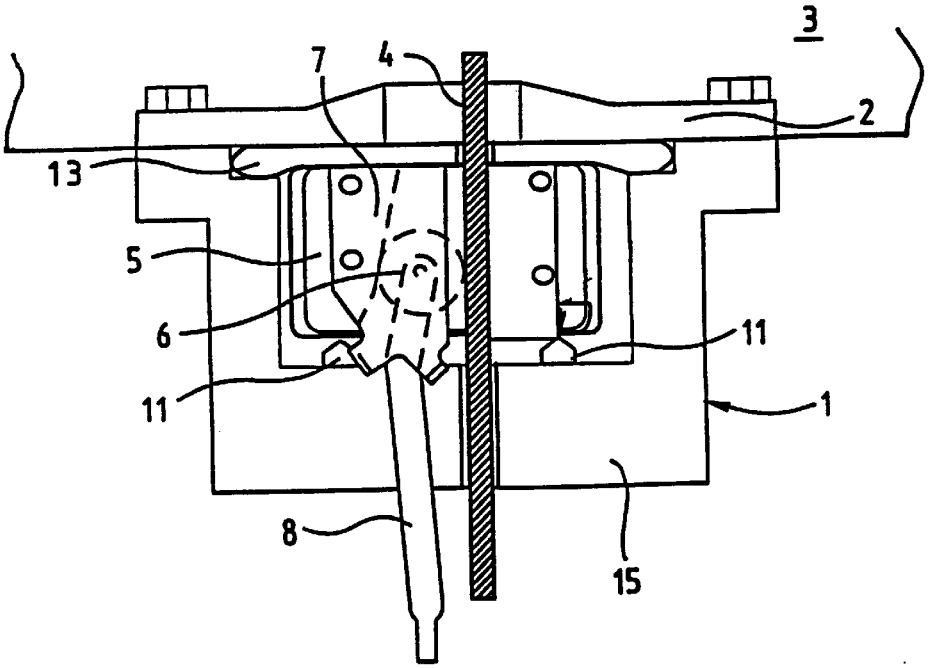
FIG. 3 shows the safety device of FIG. 1 in the braking position.

The safety device 1 and catch housing 5 are shown in the triggered and braking position in FIG. 3. The function of the equipment according to the invention is described in the following by means of this illustration.

On triggering of the safety device, such as by a device according to EP Application No. 96810763.1 (IPi 144) the catch roller 6 becomes engaged with the guide rail 4. As braking of the downward travel of the cage a vertical force transmitted by such contact acts upwardly through the catch roller upon the catch housing while a centering lateral force is simultaneously applied, both as a result of the contact between the roller and the tapered face of the plate 7. The vertical force moves the catch housing 5 upwardly against the downwardly-directed resilient force of the resilient plate 13, whereby the catch housing is immediately released from the horizontal readiness position dictated by the contact between the cones 11 and bores 12. Self-centering about the guide rail can immediately take place by the lateral movement now permitted of the catch housing 5 by contact by the roller 6 against the inclined track.

At the start of the catch housing's upward movement the pressure on the resilient plate 13 and the slide foil 5 is not yet very large, so that the necessary lateral movement of the catch housing 5 can take place in problem-free manner as a result of sliding friction between the upper surface of the catch housing 5 and the slide foil 14. In the further course of the catching or braking operation the resilient plate 13 is compressed to a fraction of its thickness by the upward travel of the catch housing 5, and thus the braking force is further transmitted, damped and sprung, by way of the cage construction part 3, to the remaining portion of the lift cage (not illustrated). Rubber with an appropriate Shore hardness is preferably used as the material for the resilient plate. The internal friction of such a resilient material acts in a damping manner in the present arrangement to yield a strong, progressive spring characteristic, appropriate for the embodiment presented.

The mount and support of the catch housing 5 of the safety device 1 according to the invention does not disturb the described function of the safety device 1 in any way. By the damped and progressively sprung transmission of the catching forces to the lift cage and the construction part 3 thereof, a correspondingly reduced peak loading of these elements results during braking by The triggered safety device 1. Due to the damped and progressively sprung start of braking/retardation, apart from a similarly smaller loading of the guide rails 4 the passengers in the lift cage experience a less jolting emergency braking.

Figure 4:
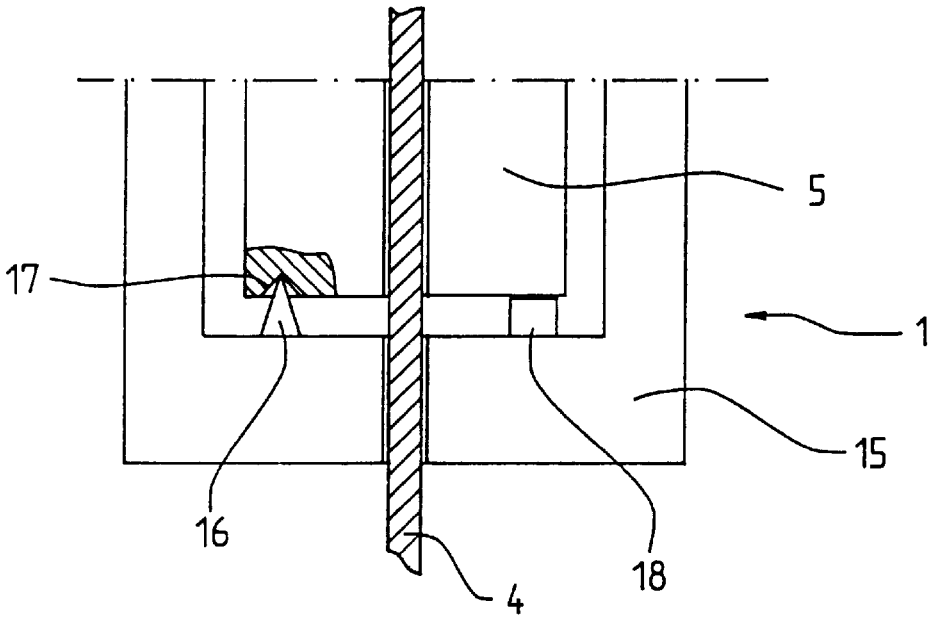
FIG. 4 shows a variant of the horizontal positional fixing means.
Figure 5:
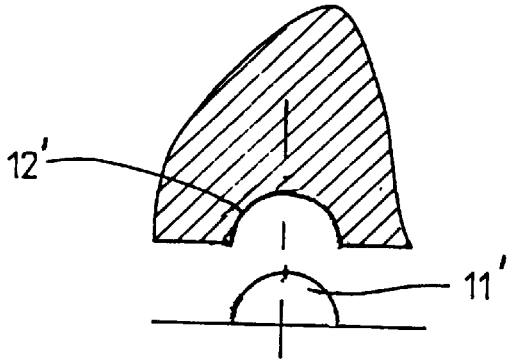
FIG. 5 shows a detail of another horizontal positioned fixing means.

As depicted in FIG. 4, a knife-edge support can be provided as an alternative construction for the horizontally orienting support for the catch housing. This can consist of a knife-edge 16 mounted to the safety device holder 15, and an oppositely disposed notch in the catch housing 5, along with a parallel abutment 18 horizontally spaced relative to the knife-edge 16. These elements can be laterally interchanged. A still further form of horizontal fixing can be achieved by means of spherical projections 11' and corresponding spherical depressions 12' in the catch housing 5 and in the safety device holder 15, as shown in FIG. 5.

Of importance in the horizontally fixing support according to the invention is the requirement that the element used for that purpose have inclined, round, or otherwise tapered contact surfaces or pointed contact points, so that the horizontal fixing is released with the smallest upward movement of the catch housing 5. Such a requirement may exclude horizontally fixing supports through use of any kind of cylindrical or parallel elements such as, for example, set pins.

As may be appreciated, the use of the mount of the catch housing 5 of a safety device 1 of the present invention is not restricted to the exemplified roller safety device. Wedge safety devices of any kind, as well as other forms of safety devices can, in appropriately adapted form, likewise be utilized with the mount.

Other materials, which have the necessary properties with respect to progressive spring characteristic and internal friction for damping, can also be used for the resilient plate 13 instead of rubber. The slide foil material can have, for example, a polytetrafluoroethylene coating, such as marketed under the TEFLON trademark, but other materials with equivalent low friction value can similarly be employed.

We claim:

1. A mount for the braking part of a safety device for a lift cage, the mount being connected to the lift cage by a carrier plate, comprising a catch housing supporting a catch roller, means for immovably supporting the catch housing in a horizontal plane in a first readiness position, and a resilient plate mounted between said catch housing and said carrier plate for damaging forces transmitted to the catch housing by the catch roller when the catch housing is released from the first readiness position during activation of the safety device.

2. The mount according to claim 1, wherein said means for immovably supporting the catch housing comprises at least one conical mount on a holder for the mount and at least one mating bore in the catch housing.

3. The mount according to claim 1, wherein said at least one mounting bore is conical.

4. The mount accordingly to claim 1, wherein the resilient plate has a face facing the catch housing covered with a slide foil having a low coefficient of friction.

5. The mount according to claim 1, wherein the resilient plate comprises a material which produces a damaging effect during compression and exhibits a progressive opening characteristic.

6. The mount according to claim 1, wherein said means for immovably supporting the catch housing in a first readiness position comprises a knife-edge support.

7. The mount according to claim 6, wherein the said means for immovably supporting the catch housing comprises spherical projection on a holder for the mount and mating spherical bores in the catch housing.

8. The mount according to claim 1, wherein said catch housing includes an inclined contact for said catch roller, said catch roller engaging said included contact upon activation of the safety device whereby said catch is driven vertically out of said first readiness position.

* * * * *